US008302654B2

(12) United States Patent
McDonald et al.

(10) Patent No.: US 8,302,654 B2
(45) Date of Patent: Nov. 6, 2012

(54) VERTICALLY COLLAPSIBLE WEATHER RESISTANT BARRIER FOR OPENING IN A BUILDING ENVELOPE

(75) Inventors: Mark McDonald, Beaconsfield (CA); Jack Zagorski, Saint Lazare (CA); Chet Lok, Toronto (CA)

(73) Assignee: Railquip Enterprises Inc., Montreal Quebec (CA)

( * ) Notice: Subject to any disclaimer, the term of this patent is extended or adjusted under 35 U.S.C. 154(b) by 552 days.

(21) Appl. No.: 12/512,935

(22) Filed: Jul. 30, 2009

(65) Prior Publication Data

US 2011/0023366 A1 Feb. 3, 2011

(51) Int. Cl.
*E05F 13/00* (2006.01)

(52) U.S. Cl. ..... 160/193; 160/40; 160/207

(58) Field of Classification Search ..... 160/40, 160/193, 201, 207, 209, 213, 84.11, 84.08, 160/218, 188, 138, 150, 159, 160, 161; 49/499.1
See application file for complete search history.

(56) References Cited

U.S. PATENT DOCUMENTS

| | | | | |
|---|---|---|---|---|
| 2,027,992 | A * | 1/1936 | Maurer | 160/159 |
| 3,755,968 | A * | 9/1973 | Williams | 49/489.1 |
| 5,062,464 | A | 11/1991 | Peterson | |
| 6,267,169 | B1 | 7/2001 | McDonald | |
| 6,808,000 | B1 | 10/2004 | Peterson | |
| 7,156,142 | B2 | 1/2007 | Peterson | |

FOREIGN PATENT DOCUMENTS

| | | |
|---|---|---|
| CA | 2 064 348 | 9/1992 |
| CA | 2 465 433 | 11/2004 |

OTHER PUBLICATIONS

Hufcor Premier Bi-Fold Door; Hufcor, Inc.; found at http://www.hufcorbifold.com/index.html; printed Oct. 26, 2009; Copyright 2008; 2 pages.

Loschwand Products; Loschwand; found at http://www.loschwand.de/eng/products/Products00.html; printed Oct. 26, 2009; 1 page.

International Search Report and Written Opinion for International Application No. PCT/CA2010/001137, mailed Oct. 12, 2010.

* cited by examiner

*Primary Examiner* — Blair M. Johnson
(74) *Attorney, Agent, or Firm* — Hunton & Williams LLP

(57) ABSTRACT

A vertically collapsible weather resistant barrier for an opening, having a plurality of side frames secured along the height of side walls and/or an intermediate post defining the opening. Each side frame has a longitudinal channel along its length facing inward toward the opening. The channel accommodates sheaves extending from the barrier and by which a ceiling mounted pulley system may house and lower the barrier with the side frame. The barrier comprises a plurality of pantograph structures at opposite ends of a plurality of panels. The arms of the pantograph structure closest to the side walls house a locking mechanism thereon facing the side frame at either end of the arm that engages a latch in and a proximate arm to pull them into tight vertical alignment when substantially fully extended. The locking mechanisms are covered by an expandable bulb seal that bulges outwardly when the locking mechanism is engaged to create a seal between the pantograph and the channel in the side wall.

23 Claims, 12 Drawing Sheets

VERTICALLY COLLAPSIBLE WEATHER RESISTANT BARRIER FOR OPENING IN A BUILDING ENVELOPE

RELATED DISCLOSURES

Not Applicable.

INTRODUCTION

Movable wall partition systems have many applications, particularly to divide areas of a building and to form smaller areas out of larger ones.

Movable partition walls are often used to divide interior building spaces, of which convention halls and large rooms in hotels, school gymnasia and work areas in factories are only a few types, into smaller spaces.

Such walls may be formed merely from fabric or other like material, and take the form of curtains which may be drawn closed or opened. Other, more durable types of movable wall partitions are made of rigid material, extending from floor to ceiling and having heat and/or sound insulating materials between a rigid wall-forming exterior.

Typically, wall partition systems of the rigid-type move horizontally. Such types of movable walls require storage space (in plan) to accommodate the wall panels when not in use. The wall panels may be very heavy and impose differing loads on the support structure, which may be ceiling or roof mounted, as the panels are moved, with the loads increasing as the panels are retracted to their storage positions.

Such horizontally movable rigid walls may be comprised of individual panels, sets of two paired panels hinged together or a plurality of panels all serially hinged together. Paired and continuously hinged panels may have exposed hinges that are considered unsightly, while individual panels are moved into position individually and provide only minimal resistance to lateral forces.

With rigid panels that are horizontally movable on tracks or rails attached to the underside of a ceiling or roof structure, automated opening and closing systems are rare, having regard to the weight and associated friction of moving the panels along the tracks.

As a result of the foregoing, vertically collapsible partition systems have been developed. Many such systems incorporate a pantograph configuration similar to that of baby gates, in which a series of beams or segments are pivotally linked together to provide a series of similar diamond-shaped structures along the length of the frame and transverse to the vertical plane to be occupied by the extended structure.

The pantograph concept for vertically collapsible wall structures has been applied to security gates or barriers for closing off access to an enclosure, such as a store-front in an enclosed shopping mall.

The existing vertically collapsible pantograph structures, such as disclosed in U.S. Pat. No. 5,062,464 entitled "Vertically Collapsible Wall Partitions" and issued Nov. 5, 1991 to Peterson; U.S. Pat. No. 6,808,000 entitled "Vertically Movable Security Partition" and issued Oct. 26, 2004 to Peterson; and U.S. Pat. No. 7,156,142 entitled "Vertically Movable Partition Wall" and issued Jan. 2, 2007 to Peterson (and which are incorporated by reference in their entirety herein) feature motorized pulley systems that pass cables through the various pantograph-defining segments, proximate to the point of intersection of adjoining segments. The cables extend to a lower intersection point and allowing the pulley system to upwardly retract it and, concomitantly, retract the entire structure.

The structures are downwardly extended by gravity and as a consequence may not fully extend to provide a vertically planar surface. Additionally, there may be gaps between the bottom of the fully extended structure and the floor, as well as between panel segments (if such are employed) and at either side of the structure between the pantograph segments and any adjoining wall of the enclosure. When used for enclosures opening out into an enclosed space such as a shopping mall, such gaps are generally not significant.

However, the concept of shopping malls having interior hallways is increasingly being eschewed in favour of so-called "big box" shopping developments where the building envelope of the store opens out into an exterior sidewalk or pathway. Rigid panels that are horizontally movable on tracks or rails attached to the underside of a ceiling or roof structure are not well suited to exterior-facing applications because snow and/or rain loading on the ceiling or roof structure may create a tendency for the panels to jam within the tracks. Existing vertically collapsible pantograph structures are also not well suited to exterior-facing applications because of the gaps described previously and the deleterious impact of the elements on the exposed cabling.

BRIEF DESCRIPTION OF THE DRAWINGS

The embodiments of the present disclosure will now be described by reference to the following figures, in which identical reference numerals in different figures indicate identical elements, and in which.

DESCRIPTION

Figure 1:
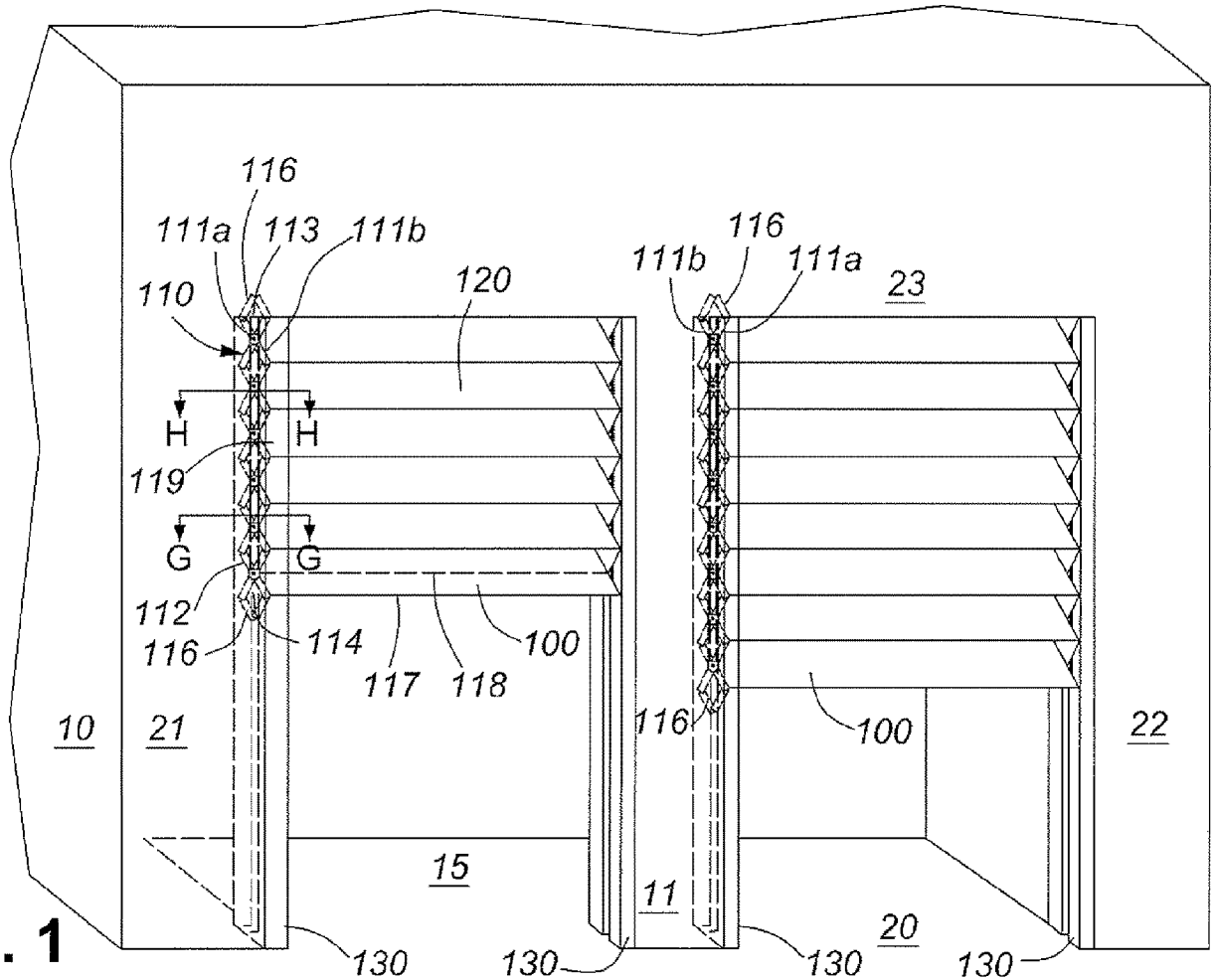
FIG. 1 is a front perspective view of an opening in a building envelope with a plurality of vertically collapsible weather-resistant barriers according to an example embodiment of the present disclosure.

Referring to FIG. 1, there is shown, an example embodiment of a vertically collapsible barrier shown generally at 100, to secure, in a weather resistant fashion, an exterior opening 20 in a building or building envelope 10. The opening 20 may be a door frame or entranceway or alternatively may be a window frame. The barrier 100, when extended, as discussed below, thus forms part of a perimeter wall of the building envelope 10. When retracted, the barrier 100 provides a means of opening up access to large portions of the interior volume 15 of the building envelope 10.

If the width of the opening 20 is considerable, the barrier 100 may in fact comprise a plurality of barrier partitions placed inline and separated by posts and/or columns 11, especially if wind shear load is a concern. Preferably, the maximum width of a single barrier partition is on the order of 12 feet but may be up to 24 or 30 feet. The posts 11 may be fixed in place or removable. Preferably, they are structural to bear and resist lateral loads on the barrier 100 due to wind pressure that are transferred to it. In certain climates, they may be thermally broken.

The barrier 100 comprises a pair of complementary pantograph structures 110 disposed at opposite side walls 21, 22 of the opening 20. If a post 11 is in place, a pair of complementary pantograph structures 110 is disposed on either side of such post 11.

Each pantograph structure 110 comprises a pair of pantograph sets 111 mounted to a side frame 130. The pantograph set 111 immediately proximate to the frame 130 is designated as the "side wall" pantograph set 111*a*, while the pantograph set 111 on the other side of the side wall pantograph set 111*a* from the side wall 21, 22 or the post 11 is designated the "inside" pantograph set 111*b*.

Each pantograph set 111 comprises a plurality of pantograph arms 112. The pantograph arms 112 within each set 111 are disposed in mutually parallel fashion. The orientation of the pantograph arms 112 in one set 111*a* is generally at an angle from the orientation of the pantograph arms 112 in the complementary set 111*b*. Preferably, each pantograph arm 112 comprises a pair of extrusions 911-912, 913-914 (FIG. 9) that each engage and are joined by a plurality of polyamide strips 404 (FIG. 4) in order to provide a thermal break. The pantograph arms 112 also may be roll formed, machined or of a composite molded material. Preferably, cavities in each extrusion may be fitted with an expandable foam or other suitable insulating material, such as is well known to those having ordinary skill in this art. Depending on the climate, thermally broken arms and insulated arms may not be implemented.

Each pantograph arm 112 in one set 111*a*, which may be considered to constitute upright side wall members, is pivotally connected at each end thereof to a pantograph arm 112 in the other set 111*b*, which may be considered to constitute upright panel members. With the exception of the pantograph arms 112 at each extremity 113, 114 of each set 111, the pantograph arms 112 are of identical length and are also pivotally connected at their respective mid-points. The pantograph arms ("split arms") 116 (FIG. 3) at each extremity 113, 114 are substantially half the length of the remaining pantograph arms 112. The plurality of pivotal connections permits the arms 112 to pivot relative to one another. Thus, each pantograph structure 110 forms a plurality of diamond structures in a plane transverse to the plane of the opening 20, that are expandable and compressible.

One end 113 of each of the pantograph structures 110 is attached to a top frame 23 of the opening 20, which may be a top portion of the door or window frame, or alternatively, a roof or ceiling structural element.

The ends of corresponding pantograph arms 112 in the inside pantograph set 111*b* of each pantograph structure 110 are horizontally connected by horizontal panel extremity members 117, while the mid-points of corresponding pantograph arms 112 in the inside pantograph set 111*b* of each pantograph structure 110 are similarly horizontally connected by a pivot pin 500 extending from horizontal panel intermediate members 118.

Thus, the pantograph arm 112 from the inside set 111*b* of one pantograph structure 110, the corresponding pantograph arm 112 from the inside set of the other pantograph structure 110, and the horizontal panel extremity member 117 and the horizontal panel intermediate member 118 interconnecting them define a rectangular panel enclosure 119 (FIG. 2) into which a panel 120 may be fitted.

Figure 2:
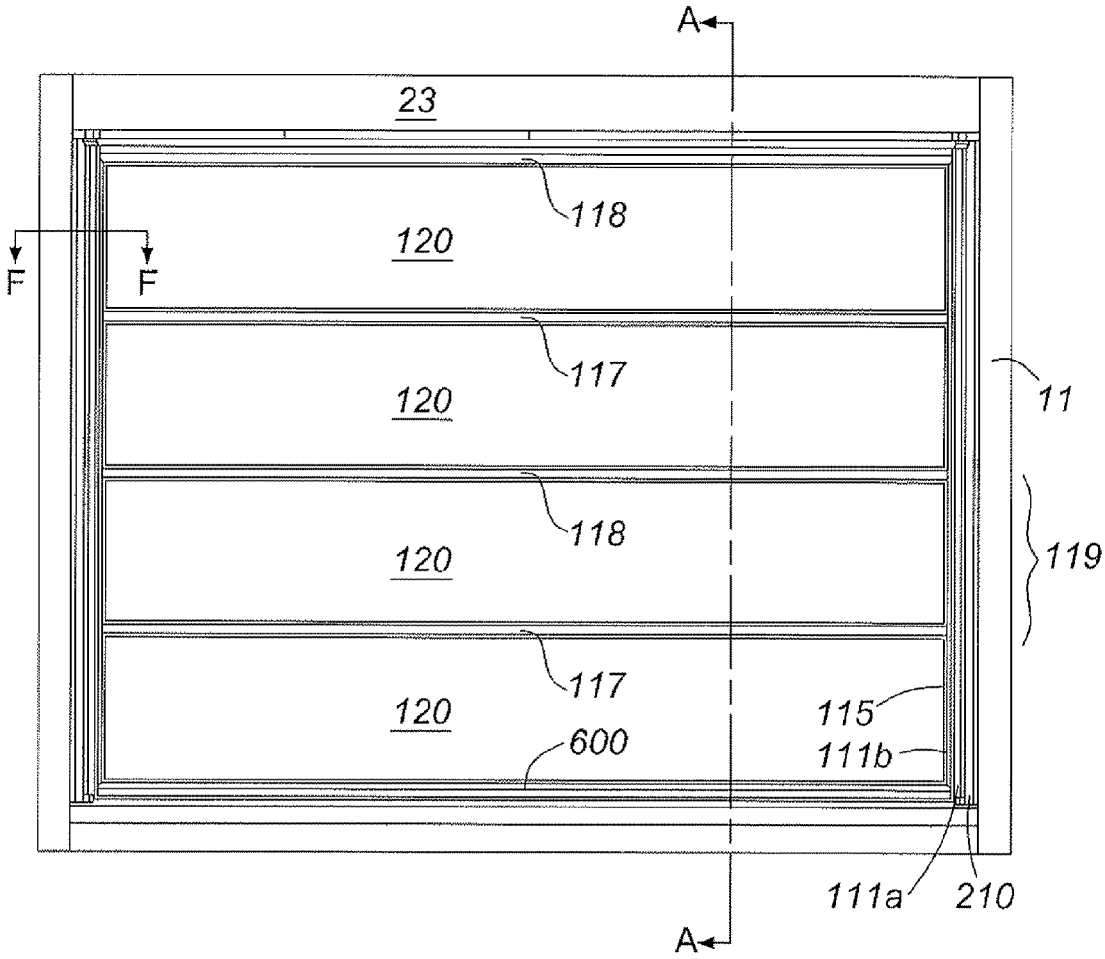
FIG. 2 is a front view of one of the barriers of FIG. 1, shown in a fully extended and locked position.
Figure 3:
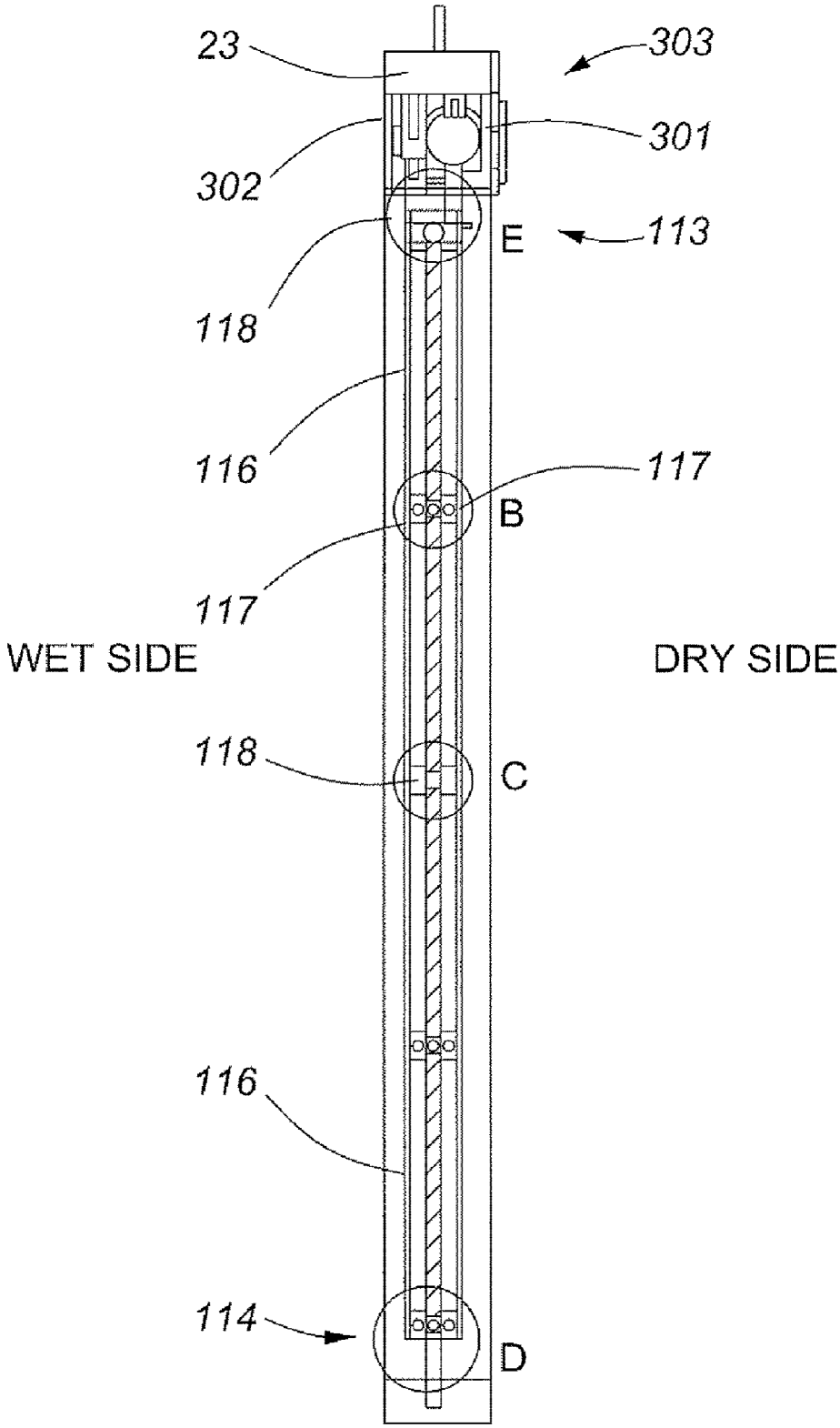
FIG. 3 is a cross-sectional view of the barrier of FIG. 2, taken along section A-A.

FIG. 2 shows a front view of one of the barriers of FIG. 1, shown in a fully extended and locked position. FIG. 3 shows a cross-sectional view of the barrier of FIG. 2, taken along section A-A. It may be seen that in the fully extended and locked position, the pantograph arms 112 have all been aligned along a common longitudinal axis parallel with the plane of each of the panels 120 so as to define a relatively vertical, planar and weather impervious barrier 100 at the opening 20.

In a recess in the top frame 23 above upper extremity 113, a gear motor 301 and a yoyo chain assembly 302 collectively comprising a lifting motor assembly 303 may be housed, to extend and retract a retraction cable 1201 (FIG. 12) along and within the side frame 130, which will permit the retraction of the barrier 100 as discussed below.

Figure 4:
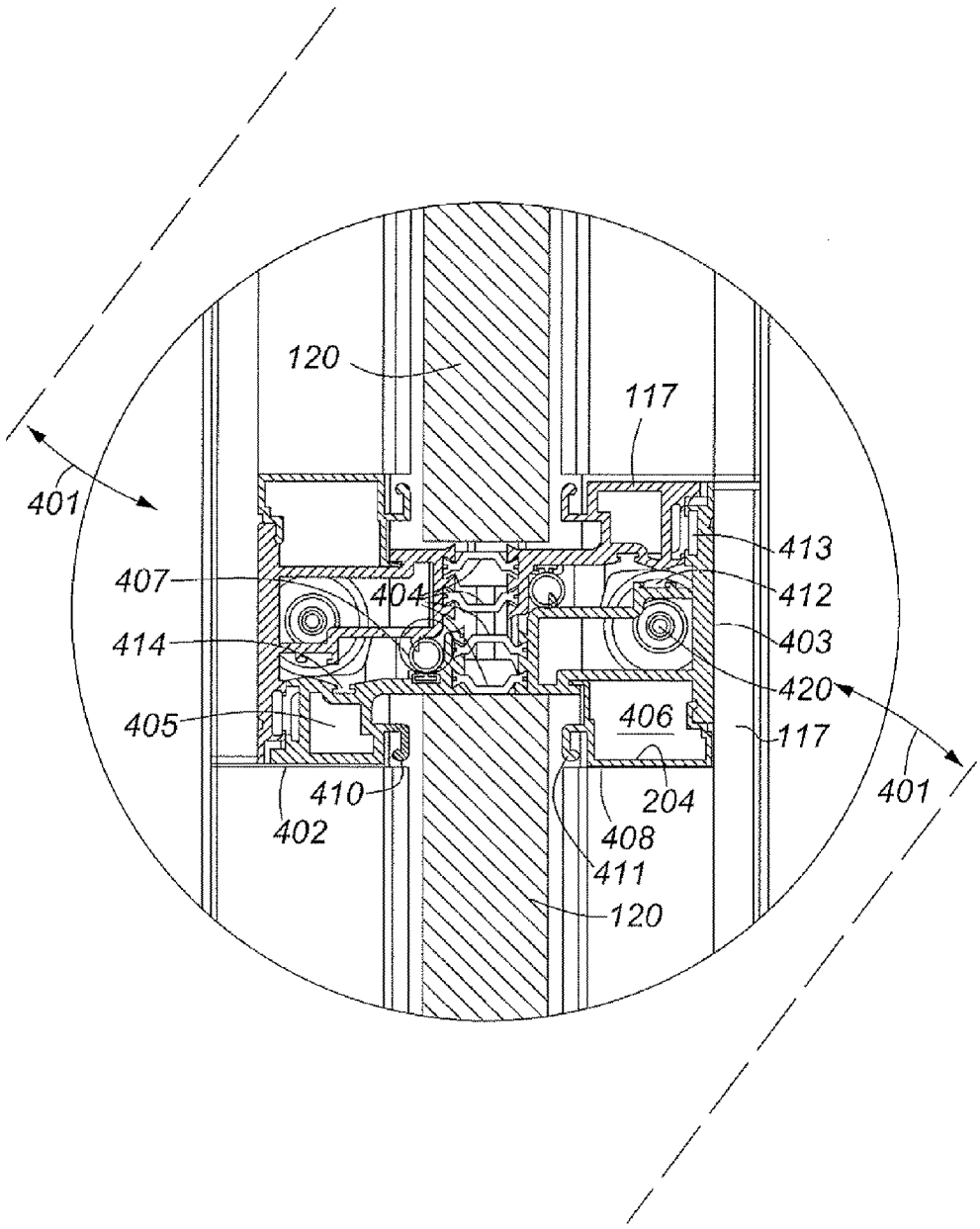
FIG. 4 is a detailed view taken at point B of the cross-sectional view of FIG. 3 showing the intersection of two horizontal panel extremity members in a fully extended and locked position.

Turning now to FIG. 4, there is shown a detailed cross-sectional view taken at position B shown on FIG. 3. The arrows shown at 401 indicate the direction of rotation of the panels 120 during the extension and/or retraction process.

The horizontal panel extremity member 117 preferably comprises two aluminum extrusion components 402 and 403 that each engage and are joined by a plurality of polyamide strips 404, which act as a thermal break across the panel 120 if desired for the climate. Preferably, gaps 405 and 406 in respective extrusions 402 and 403 are filled with an expandable foam or other suitable insulating material. Additionally, one or more air and/or moisture seals and/or sealing blocks may be provided to minimize intrusion of cold air and/or moisture. For this purpose, protuberances such as shown at 410 through 414 may be provided to provide engagement regions for such seals.

Because of the pantograph action, as the respective pantograph arms 112 are extended, the pantograph arms 112 from the inside set 111*b* tend to come together. The extrusions of the horizontal panel extremity members 117 attached thereto are configured to mate with one another to form a tight and weatherproof fit when fully extended and locked (for illustration purposes only, the bottom set of extrusions 402 and 403 is shown in black, while the upper set is shown with cross-hatching). Further weatherproofing may be provided by provision of an elastomeric bulb seal 407 adapted to engage a groove in extrusion 402 and against which extrusion 403 from the opposite horizontal panel extremity member 117 will abut in a compressible, watertight and airtight fit when fully extended.

The panels 120 may be comprised of a substantially rigid building material such as glass (preferably insulated), wood, vinyl and/or sheet metal. Other building and/or rigid materials may be found to be suitable. Preferably the height of each panel 120 is substantially between 1 and 2 feet.

Preferably, the panel 120 may be laid within a fitted recess in the enclosure 119 and held in place with trim panel 408, which engages extrusion 403 to hold the panel 120 in place. The trim panel 408 is also preferably filled with expandable foam or other form of insulation.

The horizontal panel extremity member 117 may be fixed into position with corresponding pantograph arms 112 of the inside pantograph set 111*b*, by means of a plurality of bolts 420.

Figure 5:
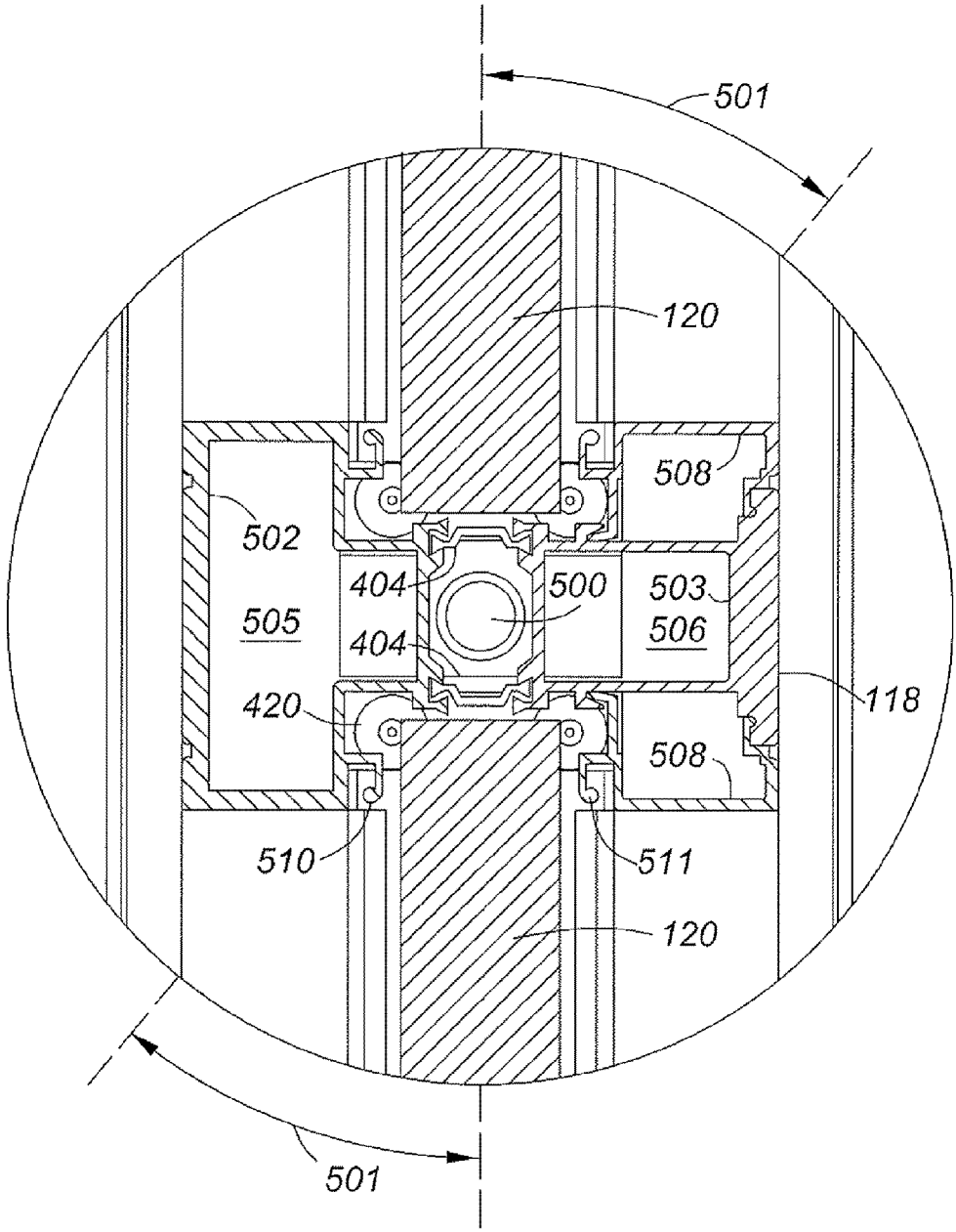
FIG. 5 is a detailed view taken at point C of the cross-sectional view of FIG. 3, showing a horizontal panel intermediate member.

FIG. 5 shows a detailed cross-sectional view of the horizontal panel intermediate member 118 taken at position C shown on FIG. 3. The horizontal panel intermediate member 118 has a pivot pin 500 extending partially through its longitudinal length at each end and protruding transversely outward, that is toward the side frame 130 and through the pantograph arms 112, which may pivot around it in the directions shown by arrows 501. The pivot pin 500 extends into the body of the side frame 130. The pantograph arms 112 may be fixed in position longitudinally along the pivot pin 500 through the use of spacers, washers, crimp rings and/or other devices, without interfering with the freedom of the pantograph arms 112 to pivot about the pivot pin 500 while the barrier 100 is being lowered or retracted.

The horizontal panel intermediate member 118 is comprised of extrusions 502 and 503 that each engage and are joined by a plurality of polyamide strips 404 in order to provide a thermal break. Preferably, cavities 505 and 506 of respective extrusions 502 and 503, and areas between the polyamide strips 404 and pivot pin 500, may be filled with an expandable foam or other suitable insulating material. Additionally, one or more air and/or moisture seals and/or sealing blocks may be provided to minimize intrusion of cold air and/or moisture. For this purpose, protuberances such as shown at 510 and 511 may be provided to provide engagement regions for such seals.

The horizontal panel intermediate member 118 serves to present a fitted recess in the enclosure 119 into which the panel 120 may be laid and held in place with trim panels 508 that engage extrusion 503 to hold the panel 120 in place. The trim panels 508 are also preferably filled with expandable foam or other form of insulation.

The horizontal panel intermediate member 118 may be fixed into position with corresponding pantograph arms 112 of the inside pantograph set 111*b* by means of a plurality of bolts 420.

Figure 6:
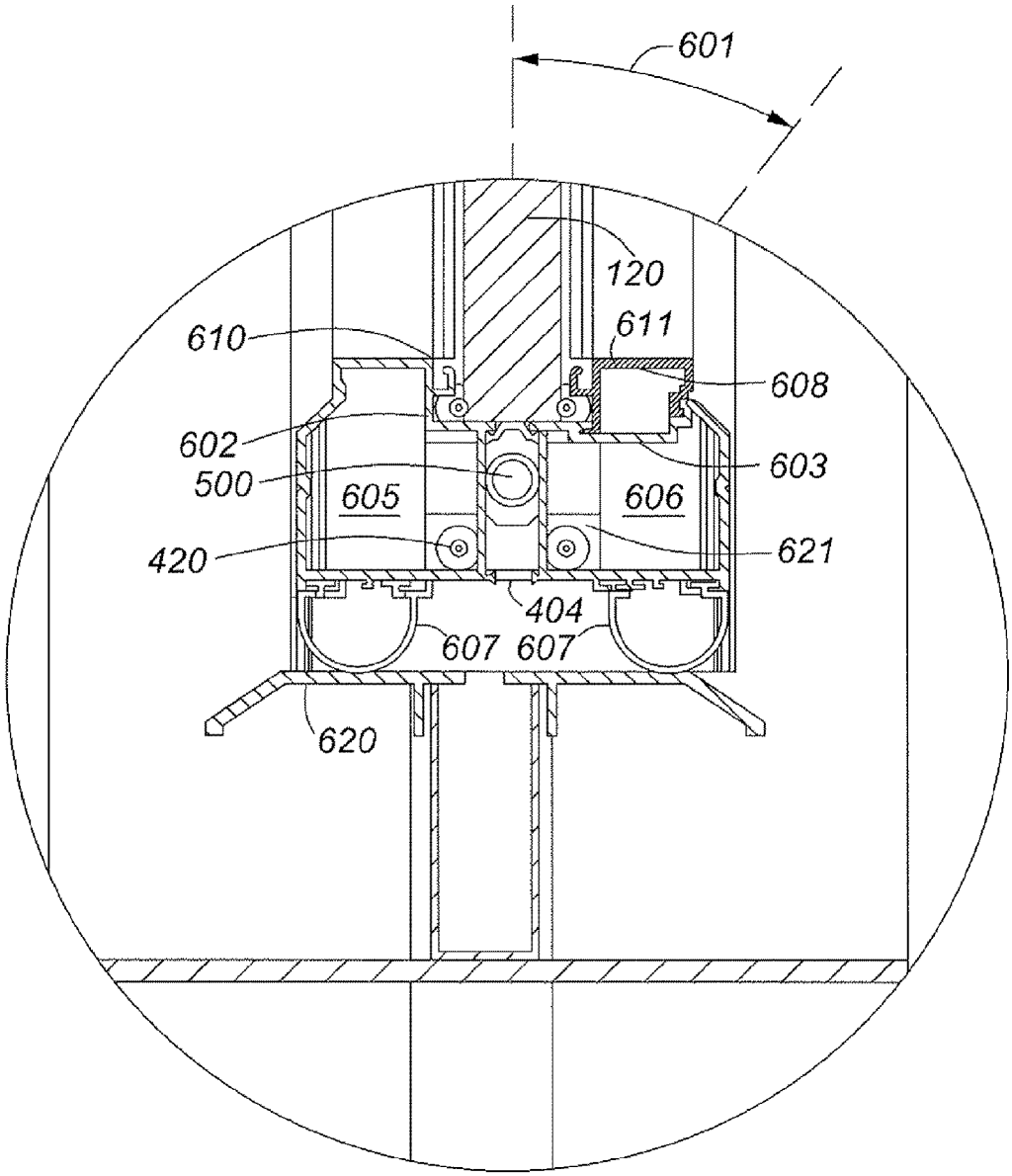
FIG. 6 is a detailed view taken at point D of the cross-sectional view of FIG. 3, showing a split member positioned at the bottom of the opening.

Referring now to FIG. 6, which shows a detailed cross-sectional view of the bottom of the lower split arm 116 at extremity 114 taken at position D shown on FIG. 3, the horizontal panel intermediate member 118 is modified slightly to provide a horizontal panel bottom member 600. In effect, the horizontal panel bottom member 600 may be considered to be the top half of the horizontal panel intermediate member, with minor adjustments to accommodate the central pivot pin 500, which has been vertically translated downward and to provide a weathertight seal of the opening 20 when extended in the locked position.

As with the horizontal panel intermediate member 118, the horizontal panel bottom member 600 has a pivot pin 500 extending partially through its longitudinal length at each end and protruding transversely outward, that is toward the side frame 130 and through the lower split arms 116, which may pivot around it in the directions shown by arrow 601. The pivot pin 500 extends into the body of the side frame 130. The lower split arms 116 may be fixed in position longitudinally along the pivot pin 500 through the use of spacers, washers, crimp rings and/or other devices, without interfering with the freedom of the lower split arms 116 to pivot about the pivot pin 500 while the barrier 100 is being lowered or retracted.

The horizontal panel bottom member 600 is comprised of extrusions 602 and 603 that each engage and are joined by a plurality of polyamide strips 404 in order to provide a thermal break. Preferably, cavities 605 and 606 of respective extrusions 602 and 603, and areas between the polyamide strips 404 and pivot pin 500, may be filled with an expandable foam or other suitable insulating material. Additionally, one or more air and/or moisture seals and/or sealing blocks may be provided to minimize intrusion of cold air and/or moisture. For this purpose, protuberances such as shown at 610 and 611 may be provided to provide engagement regions for such seals.

Additionally, a plurality of bulb seals 607 may be attached to the bottom of the extrusions on both the wet and dry sides of the barrier 100 to engage an optional floor threshold 620 which may be formed within. The floor threshold 620 may cover a recess within the floor or window sill or be positioned slightly above, to provide a tight, substantially weatherproof seal when the barrier 100 is fully extended in the locked position.

The horizontal panel bottom member 600 serves to present a fitted recess in the enclosure 119 into which the panel 120 may be laid and held in place. The trim panel 608 engages extrusion 603 to hold the panel 120 in place. The trim panel is also preferably filled with expandable foam or other form of insulation.

The horizontal panel bottom member 600 may be fixed into position with corresponding pantograph arms 112 of the inside pantograph set 111*b* by means of a plurality of bolts 420. Here, the mounting bracket 621 into which the bolts 420 are mounted may be seen.

Figure 7:
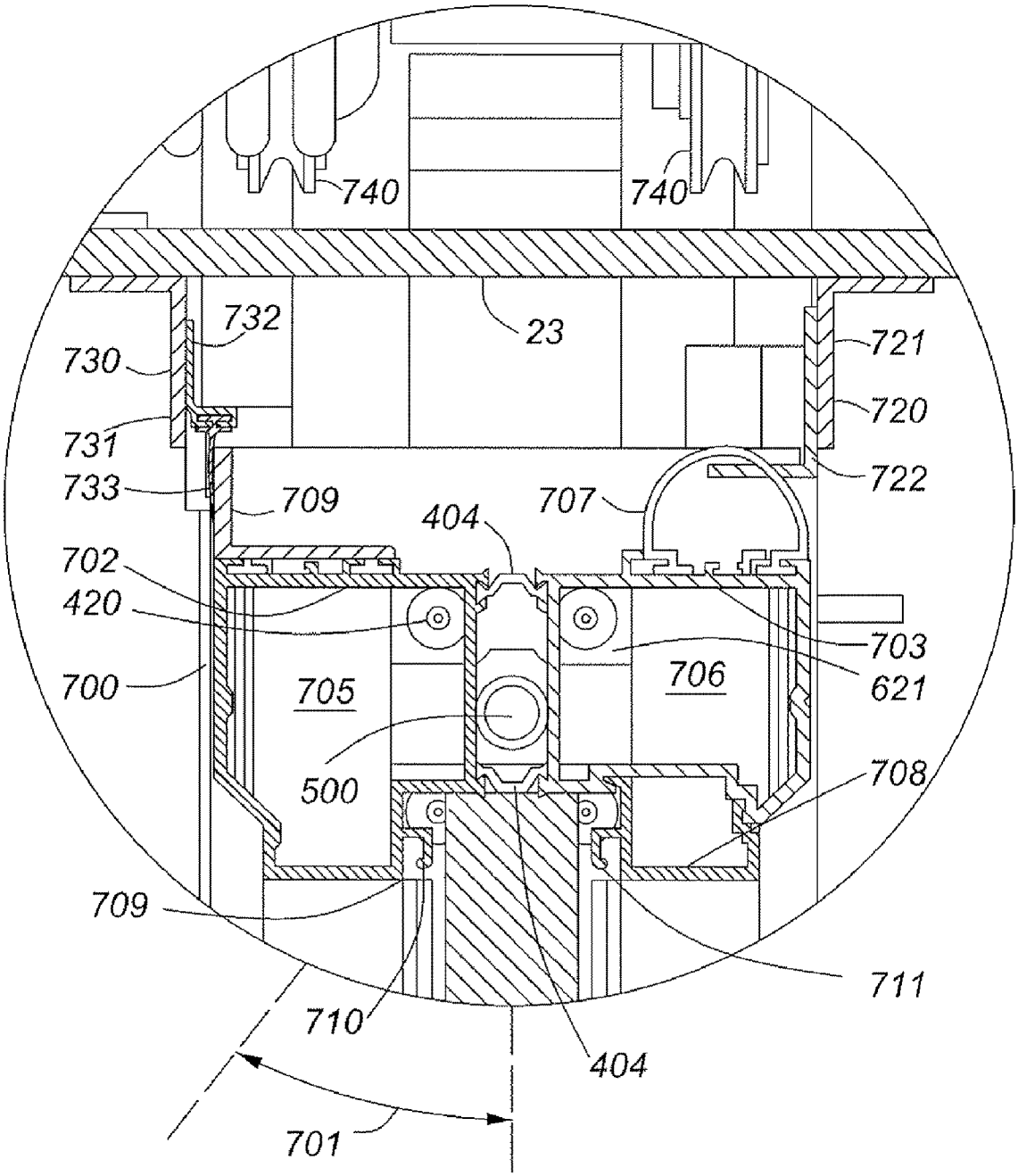
FIG. 7 is a detailed view taken at point E of the cross-sectional view of FIG. 3, showing a split member positioned at the top of the opening.

Referring now to FIG. 7, which shows a detailed cross-sectional view of the top of the upper split arm 116 at extremity 113 taken at position E shown on FIG. 3, the horizontal panel intermediate member 118 is modified slightly to provide a horizontal panel top member 700. In effect, the horizontal panel top member 700 may be considered to be the bottom half of the horizontal panel intermediate member, with minor adjustments to accommodate the central pivot pin 500, which has been vertically translated upward and to provide a weathertight seal of the opening 20 when extended in the locked position.

As with the horizontal panel intermediate member 118, the horizontal panel top member 700 has a pivot pin 500 extending partially through its longitudinal length at each end and protruding transversely outward, that is toward the side frame 130 and through the upper split arms 116, which may pivot around it in the directions shown by arrow 701. The pivot pin 500 extends into the body of the side frame 130. The upper split arms 116 may be fixed in position longitudinally along the pivot pin 500 through the use of spacers, washers, crimp rings and/or other devices, without interfering with the freedom of the upper split arms 116 to pivot about the pivot pin 500 while the barrier 100 is being lowered or retracted.

The horizontal panel top member 700 is comprised of extrusions 702 and 703 that each engage and are joined by a plurality of polyamide strips 404 in order to provide a thermal break. Preferably, cavities 705 and 706 of respective extrusions 702 and 703, and areas between the polyamide strips 404 and pivot pin 500, may be filled with an expandable foam or other suitable insulating material. Additionally, one or more air and/or moisture seals and/or sealing blocks may be provided to minimize intrusion of cold air and/or moisture. For this purpose, protuberances such as shown at 710 and 711 may be provided to provide engagement regions for such seals.

Additionally, a bulb seal 707 may be attached to the top of the extrusion 706 on the dry side only of the barrier 100 to engage a stop 720 attached to the top frame 23, to provide a tight substantially weatherproof seal when the barrier 100 is fully extended in the locked position. The stop 720 may preferably comprise a pair of L-shaped angle pieces. A first piece 721 is bolted to the top frame and the upright portion of the first piece 721 is bolted to the upright portion of the second angle piece 722 to provide a horizontal surface offset from the top frame 23 against which the bulb seal 707 may abut. During installation, the relative positions of the two upright portions may be adjusted to account for minor variations in height of various openings 20.

On the wet side, a stop gauge 709 may be attached to the top of the extrusion 705 on the wet side of the barrier 100 to engage a stop 730 attached to the top frame 23, to provide still further protection to the enclosure 10 against the elements. The stop 730 may preferably comprise a pair of L-shaped angle pieces 731, 732, configured in similar fashion to angle pieces 721, 722. More preferably, a weather strip 733 may be configured to hang substantially vertically from the stop 730 in such a position that it will be pinched between the stop gauge 709 and the second angle piece 732 to provide a seal at the wet side junction between the top frame 23 and the barrier 100.

The nature of the pantograph movement is such that when the barrier 100 is being extended, the top of the barrier 100 will simultaneously move vertically upwards to engage the top frame 23. The pantograph arms 112 rotate about the pivot pin 500 causing seal 707 and weather strip 733 to be engaged by vertical or lateral pressure exerted by rotation of the top member 700.

The horizontal panel top member 700 serves to present a fitted recess in the enclosure 119 into which the panel 120 may be laid and held in place with trim panel 708 that engages extrusion 703 to hold the panel 120 in place, which trim panel is also preferably filled with expandable foam or other form of insulation.

The horizontal panel top member 700 may be fixed into position with corresponding pantograph arms 112 of the inside pantograph set 111*b* by means of a plurality of bolts 420. Here, the mounting bracket 621 into which the bolts 420 are mounted may be seen.

Above, or recessed within the top frame 23 may be provided one or more sheaves 740. The outer circular surface of such sheaves are grooved to accommodate a loop of a retraction cable 1201 (FIG. 12) therearound, which retraction cable is unwound from a retraction spool 1202 (FIG. 12) positioned above each pantograph structure 110 and driven by the lifting motor assembly 303. While no sheave 740 is strictly necessary, as the retraction cable may be unwound from the retraction spool 1202 directly, provision of one or more sheaves 740 permits additional loops of retraction cable to be extended downward and provides improved mechanical advantage in retracting the barrier 100.

Figure 8:
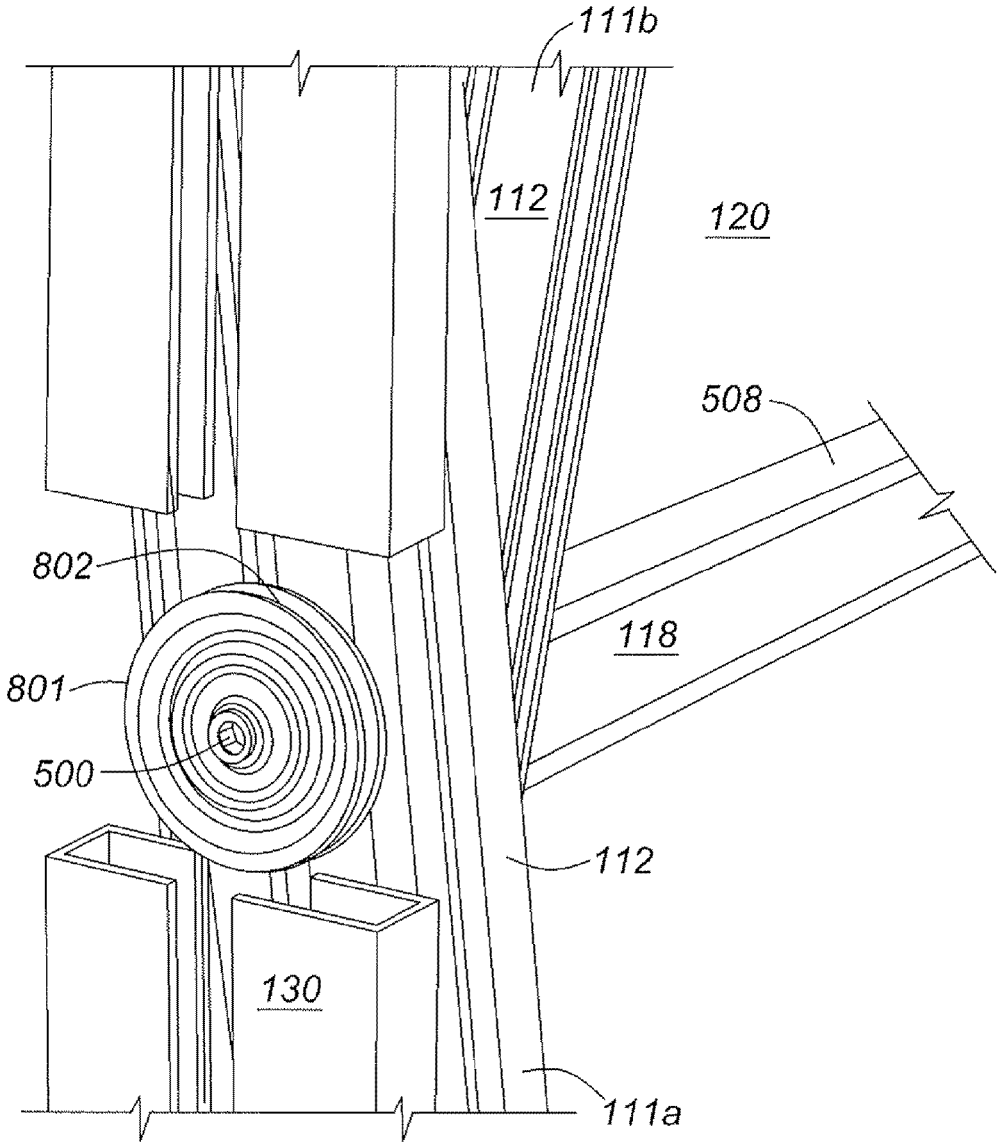
FIG. 8 is a front perspective detailed view partially cut away, of the intersection of the left wall track and respective arms of the inside and side wall pantograph sets of the one of pantograph structures of FIG. 1 taken at section G-G.

FIG. 8 is a front perspective detail view of the intersection of the left wall track and respective arms of the inside and side wall pantograph sets of one of the pantograph structures of FIG. 1 along section G-G.

The side frame 130 is shown partially broken away in order to illustrate that the pivot pin 500 extends from the horizontal panel intermediate member 118, through the intersecting pantograph arms 112 that comprise the inside pantograph set 111*b* and the side wall pantograph set 111*a* and protrude further outward, terminating in a sheave 801. The sheave 801 is fitted on the end of the pivot pin 500 and adapted to freely rotate thereabout. The sheave 801 fits within the pantograph track 130, which extends vertically flush with and along the inside of each side wall 21, 22 and/or on each side of the post 11 and substantially along the entirety of its height thereof. A sheave 801 will similarly be fitted on the end of the pivot pins 500 extending through and out of each end of the horizontal panel bottom member 600 in like manner.

The outer circular surface 802 of each sheave 801 is grooved to accommodate a loop of the retraction cable 1201 therearound. As there are a plurality of sheaves 801 extending within the track 130 (one per horizontal panel intermediate member 118, and one for the horizontal panel bottom member 600), not all of the sheaves 801 will have a loop of retraction cable 1201 wound therearound.

Indeed, in some example embodiments, only one sheave 801 need be so wound. The position of such sheave 801 relative to the extended barrier 100 may be dictated by such factors as the amount of retraction cable 1201 to be supplied (more for a lower-positioned sheave 801); the capacity of the retraction spool 1202 (larger for a lower-positioned sheave 801); the desired amount of fine positioning control over the extension of the barrier 100 (more for a lower-positioned sheave 801); and other factors such as cable tension, loads and stresses in the pantograph arms 112 and their pivot pins 500.

One characteristic, however, of pantograph structures is that the amount of extension of each of the diamond-shaped structures in the direction of extension is the same. Thus, conceivably, the retraction cable 1201 may be looped about one of the intermediate sheaves 801, in order to save space in terms of the amount of retraction cable 1201 to be used and spooled, although at a cost of less precision over the retraction and extension of the barrier 100.

For purposes of mechanical advantage, it may be appropriate to implement a multiple loop structure through a pulley mechanism using one or more sheaves 740 proximate to the retraction spool 1202 (as shown in FIG. 7) and wind a loop around each of a plurality of sheaves 801.

Figure 9:
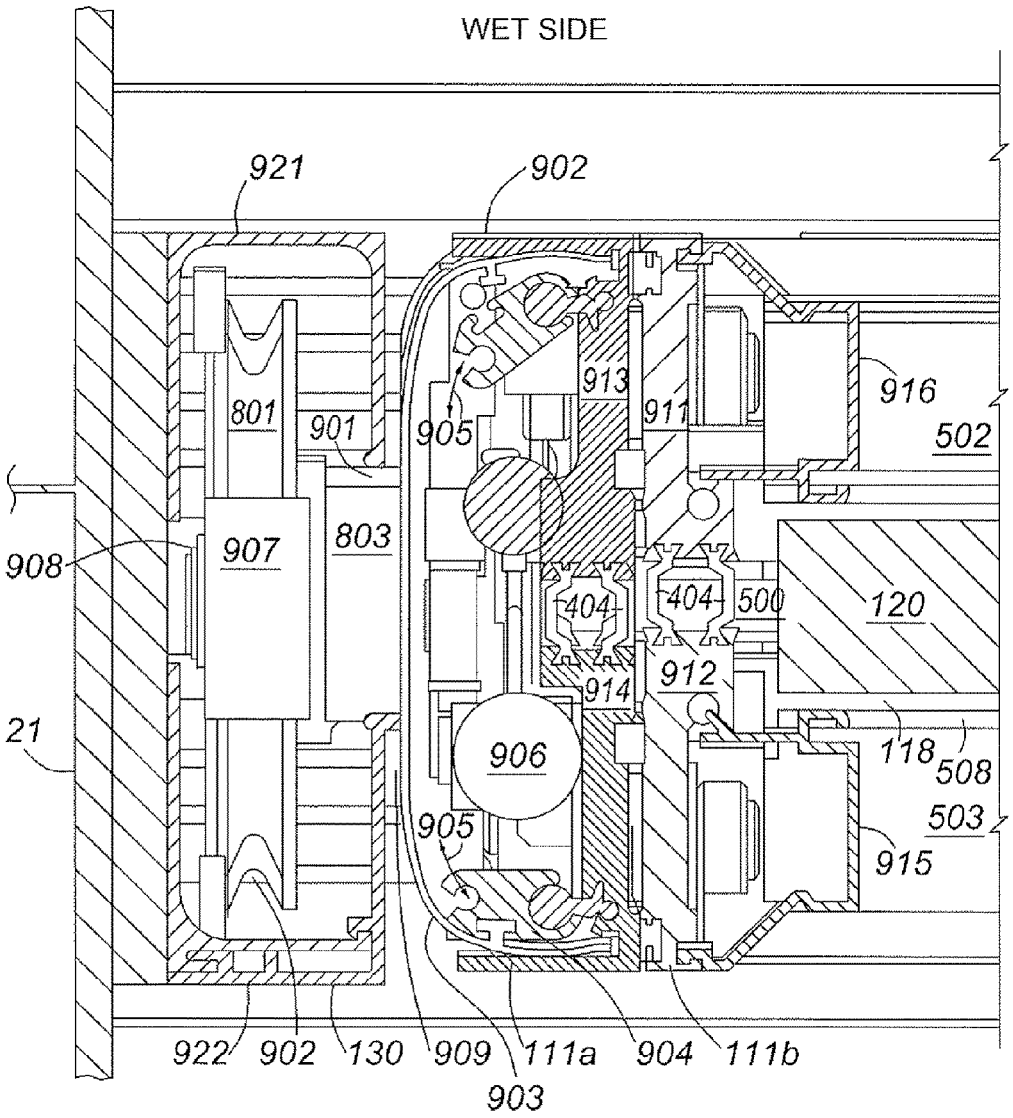
FIG. 9 is a cross-sectional detail in plan view taken along section F-F of the interaction between the horizontal panel intermediate member, the inside and side wall pantograph sets and the side frame of F*igure* 2.

Turning now to FIG. 9, which shows the interaction between the horizontal panel intermediate member 118, the inside pantograph set 111*b*, the sidewall pantograph set 111*a* and the side frame 130 at section F-F, a single opening 901 extends along the length of the side frame 130 facing the pantograph structure 110, to accommodate the pivot pin 500 and the sheave 801. The sheave 801 is mounted on the pivot pin 500 by mounting bearing 907. Preferably, the opening 901 is sized to as to accommodate a guide roller 803 encircling the pivot pin 500 as it exists at the side wall pantograph set 111*a* in a sliding fit while at the same time providing lateral (dry side to wet side) stability so as to act as a guide to the lateral position of the sheave 801 as it rides up and down within the side frame 130.

A cable guide 908 may preferably be affixed to and extend radially beyond the far end (toward the side wall 21 of the sheave 801 to inhibit travel by the retraction cable 1201 out of the groove 802 of the sheave, especially when the barrier 100 is in a fully extended and locked position and the tension in the retraction cable 1201 may slacken from excessive unwinding.

Preferably the opening 901 is at least partially sheltered from the elements by a plurality of strips of rubber and/or EVA foam weatherstripping (shown as 909 in FIG. 9) extending along the length thereof from either side of the opening 901, creating a flexible slit through which the pivot pin 500 may pass but that tends to close up when guide roller 803 has passed by.

Preferably the side frame 130 is unitary along its length, so as to protect the sheaves 801 and retraction cable 1201 housed therein from the elements including wind loads, rain and snow. Use of a unitary frame 130 reduces the number and/or size of joints between pantograph arms and between pantograph arms and the surface that are to be sealed off against wind and rain and minimizes wear of the seals caused by the cable 1201 passing therethrough.

It may be seen in FIG. 9 that the pantograph arms 112 in the inside pantograph set 111*b* and the side wall pantograph set 111*a* may also comprise a plurality of extrusions 911-912 and 913-914 respectively, each engaging and being joined by polyamide strips 404, which act as a thermal break.

As well, as with the horizontal panel extremity members 117 and horizontal panel intermediate members 118, extrusions 911 and 912 comprising the pantograph arms 112 of the inside pantograph set 111*b* may provide a fitted recess in the enclosure 119 into which the panel 120 may be laid and held in place with trim panels 915 and 916 respectively. Preferably, trim panels 915 and 916 are filled with expandable foam or other form of insulation.

It may also be seen that the side frame 130 may comprise a plurality of extrusions 921, 922 to facilitate positioning of the sheave 801 within the opening 901 laterally rather than vertically. Preferably, for security reasons, the second extrusion 922 is positioned on the dry side of the barrier 100.

Regardless of the configuration, however, the retraction cable 1201 is effective only for upward retraction of the panels 120. Downward extension of the barrier 100 is primarily a function of gravity working on the mass of the panels 120. The rate of the downward extension of the barrier 100 is primarily limited by the extension of the retraction cable 1201 as it is unspooled from the retraction spool 1202.

Even so, internal resistance due to friction of the seals when the pantograph arms 112 are near parallel and substantially in a fully extended position will prevent complete extension of the barrier 100 sufficient to preclude the incursion of wind, rain or snow within the building envelope 10.

As a result, the barrier 100 comprises a locking mechanism shown generally at 902 to pull the pantograph structures 110 closed and produce a secure and substantially air and water tight seal of the opening 20.

The components of the locking mechanism 902 are housed at each end of each pantograph arm 112 within the side wall pantograph set 111*a*. As shown in FIG. 9, the locking mechanism 902 is preferably protected from the elements by an expandable bulb seal 903. The degree of expansion of the expandable bulb seal 903 depends upon the position of a pair of side arms 904 to which the horizontal extremities of the expandable bulb seal 903 are affixed and that may rotate inwardly as shown by arrows 905 under control of a servo motor 906 that forms part of the locking mechanism 902.

As described below, as the locking mechanism 902 is engaged when the barrier 100 is fully extended, the servo motor 906 concomitantly causes the side arms 904 to incline toward one another, causing the expandable bulb seal 903 to balloon outwards toward the side frame 130. This creates a weatherproof seal of both the side wall pantograph set 111*a* as well as the opening 901 in the side frame 130, to protect the sheave 801, the pivot pin 500 and the mounting bearing 907 from the elements.

When the locking mechanism 902 is disengaged in preparation for retracting the barrier 100, the servo motor 906 concomitantly causes the side arms 904 to return to an outward facing position, causing the expandable bulb seal 903 to retract slightly and disengage from the opening 901.

Figure 10:
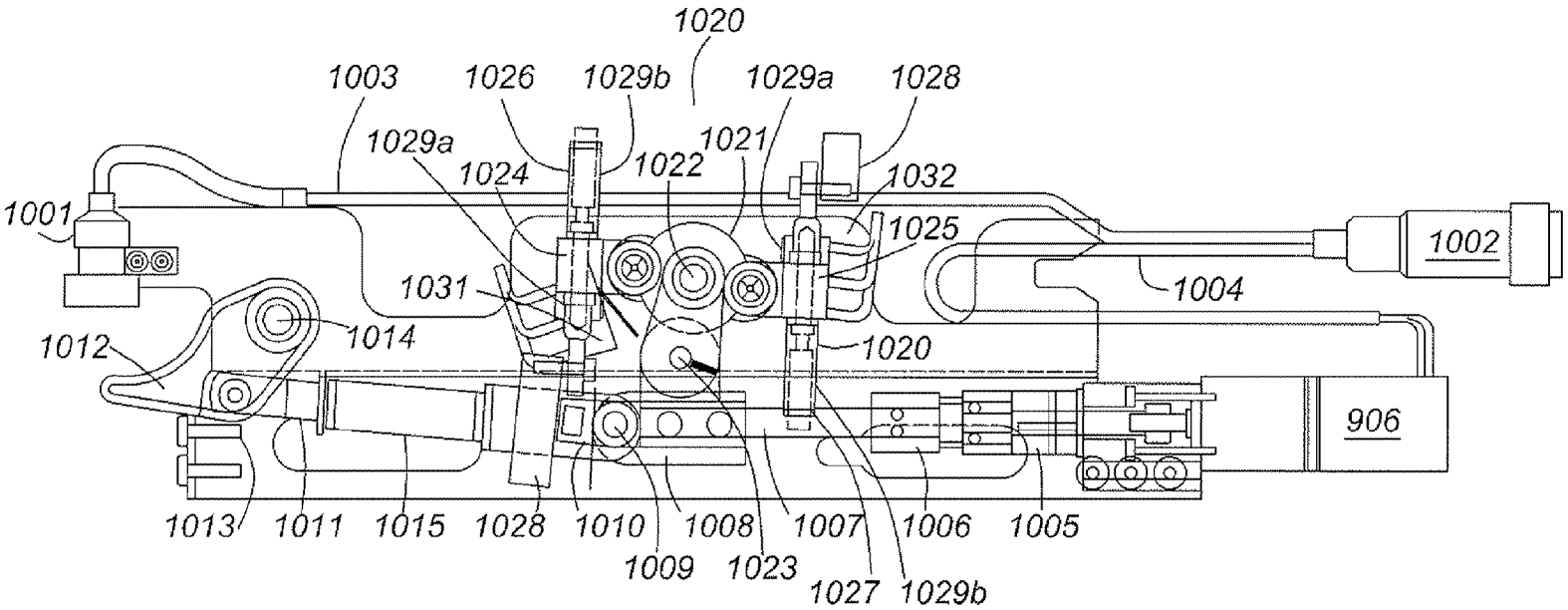
FIG. 10 is a plan view of the locking mechanism housed on the pantograph arms of the side wall pantograph set of the barrier of FIG. 1.
Figure 11:
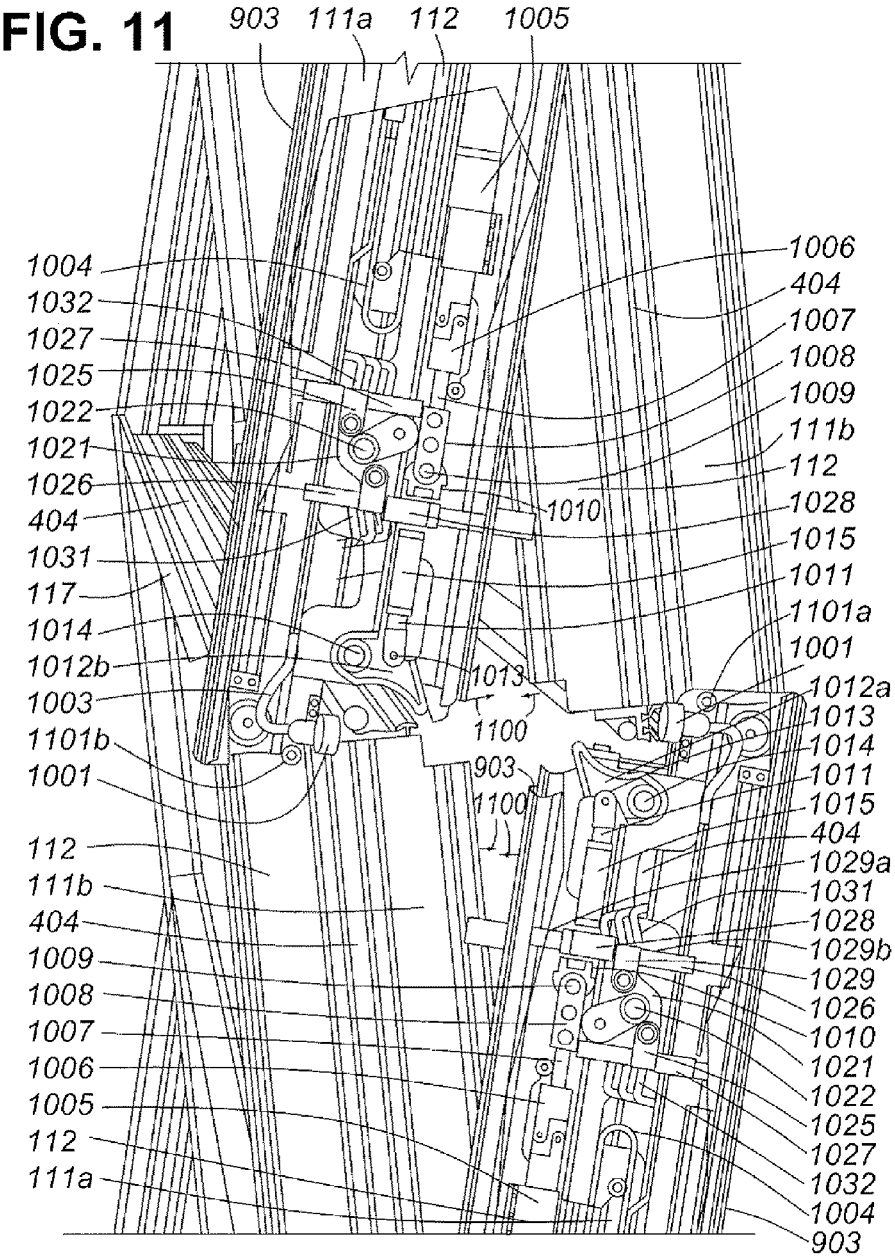
FIG. 11 is a side view, partially broken out, of the inside and side wall pantograph sets of one of the pantograph structures of FIG. 1, taken at section H-H.

The operation of the locking mechanism 902 may be better understood from consideration of FIGS. 10 and 11, which respectively show the locking mechanism 902 in isolation and as positioned on the pantograph arms 112 of the side wall pantograph set 111*a* at section H-H shown on FIG. 1.

Electrical power for the locking mechanism 902 is provided to the servo motor 906 through a connector 1001 that mates with a corresponding connector 1002 from another (higher) pantograph arm 112. The split arm 116 at the upper extremity 113 has its connector 1001 connected to a connector 1002 connected to a power source (not shown) housed within a recess in the top frame 23 that may comprise a programmable logic controller (PLC). At each pantograph arm 112, power received at the connector 1001 is distributed to the downstream connector 1002 along cable 1003 to be passed on to a connector 1002 on the next lower pantograph arm 112. Power is also fed from connector 1001 to the servo motor 906 along cable 1004.

The nature of the series of connectors 1001, 1002 is such that electrical connection is not achieved until the barrier 100 is substantially fully extended and in a position whereby the locking mechanism 902 should be engaged in order to ensure a vertical planar disposition of the barrier 100 and sealing off of the opening 20 from the elements. When the barrier 100 reaches the extended position, the PLC (not shown) energizes the motors 906 for a preset period of time, typically several seconds, to activate the locking and sealing mechanisms as described below.

The servo motor 906 is mounted in place on a mounting block 1005 affixed to the pantograph arm 112 and drives a universal joint 1006 that translates rotational movement of the shaft of the motor 906 into translational extension and retraction of a primary shaft 1007. Preferably, the shaft 1007 is a rod that is threaded at its far (relative to the servo motor 906) end to firmly engage a slider and cover 1008. The slider and cover 1008 is pivotally attached at 1009 to a yoke slider 1010, which in turn is connected to a secondary shaft 1011.

The secondary shaft 1011 is pivotally connected to a latch hook 1012 at a point 1013 that is offset from a pivot axis 1014 of the latch hook 1012, thus causing, upon extension of the primary shaft 1007 upon engagement of the motor 906, the latch hook 1012 to rotate about its pivot axis 1014 and engage a catch pin 1101 (FIG. 11) on an intersecting pantograph arm 112 to pull the arms 112 firmly into a mutually planar arrangement. The motion of the latch hook 1012 engaging the catch pin 1101 also serves to pull the corresponding pantograph arms 112 tightly together, in a manner that could not be achieved simply by gravitational forces.

Preferably, the secondary shaft 1011 is surrounded by a spring 1015 to compress and protect the locking mechanism 902 and motor 906 from damage in the event the latch hook 1012 or guide arms become jammed. Engagement of the spring signals this situation to the motor 906 so that the motor 906 may switch off as a safety measure and to minimize the likelihood of burning out the motor 906. The motor will switch off only when the pivot block 1021 rotates and trips the micro switches 1031, 1032 at both of its end positions. If full movement of latch hook 1012 and/or connectors 1028 are restricted by an outside obstruction then the springs 1015, 1029*a* and/or 1029*b* compress and allow the pivot block to rotate fully, thus protecting the motor 906.

As suggested above, as the locking mechanism 902 is engaged when the barrier 100 is fully extended, the motor 906 concomitantly causes the side arms 904 to retract, or incline toward one another, causing the expandable bulb seal 903 to balloon outwards toward the side frame 130. This is achieved by means of an end seal actuator assembly 1020. The end seal actuator assembly 1020 comprises a pivot block 1021 adapted to pivot about a central point 1022 and pivotally attached to the slider and cover 1008 at a point 1023 offset therefrom. This causes the pivot block 1021 to pivot about its central point 1022 in response to the linear motion of the cover and block 1008 under the longitudinal urging of the primary shaft 1007. In the embodiment disclosed in FIG. 10, extension of the primary shaft 1007 causes clockwise rotation of the pivot block 1021 about its central point 1022 and retraction of the primary shaft 1007 causes counter-clockwise rotation of the pivot block 1021 about its central point 1022.

The pivot block 1021 is shown as being generally T-shaped, with the central point 1022 located at the junction of the T mid-way between the T-arms of the pivot block 1021. A pair of actuator links 1024, 1025 are pivotally attached to respective T-arms of the pivot block 1021 and are adapted to accept along a bore therewithin, respective actuator arms 1026, 1027.

Actuator arms 1026, 1027 have a connector 1028 at one end thereof adapted to engage a corresponding one of the side arms 904 to which the extremities of the expandable bulb seal 903 are attached. On either side of the actuator link 1024, 1025, the actuator arms 1026, 1027 are surrounded by first and second springs 1029*a*, 1029*b* that permit fine adjustments of the positions of the individual actuator arms 1026, 1027 to provide accurate extended and retracted positions for a given pantograph arm 112.

Positioned proximate to the T-arms of the pivot block 1022 are first and second microswitches 1031, 1032. Microswitch 1031 is positioned such that when one of the T-arms (corresponding to actuator arm 1026) is sufficiently retracted, when the pivot block 1022 is rotated in a clockwise direction as a result of the extension of the primary shaft 1007, the microswitch 1031 is triggered, interrupting power to the motor 906, thus controlling the maximum extension of the primary shaft 1007 and preventing the latch hook 1012 from over-rotating in the clockwise direction, while maintaining a firm grip on the catch pin 1101. This also controls the maximum extent to which the extendable bulb seal 903 will be retracted inward (and concomitantly expand outwards).

Microswitch 1032 is positioned such that when one of the T-arms (corresponding to actuator arm 1027) is sufficiently extended, when the pivot block 1022 is rotated in a counter-clockwise direction as a result of the retraction of the primary shaft 1007, the microswitch 1032 is triggered, thus controlling the maximum extent of retraction of the primary shaft 1007 and preventing the latch hook 1012 from over-rotating in the counter-clockwise direction and disengaging from the catch pin 1101. This also controls the maximum extent to which the extendable bulb seal 903 will be extended outward (and concomitantly flatten).

Thus, it may be seen that the microswitches 1031, 1032 permit the motor 906 to drive for an extended period of time to extend and to retract the latch hook 1012, while providing individual control of the corresponding retraction and extension of the actuator arms 1026, 1027 to control the extension and retraction of the expandable bulb seal 903, which presumably uses only a portion of the extension/retraction of the primary shaft 1007.

FIG. 11 shows the interaction of the locking mechanism 902 on each of two pantograph arms 112 within the side wall pantograph set 111*a* that interact with one another, taken at section H-H shown on FIG. 1, at a point just before the locking mechanism 902 is engaged, when the pantograph structure 110 is mostly extended. The expandable bulb seal 903 covering the pantograph arms 112 within the side wall pantograph set 111*a* is shown partially broken away for purposes of illustrating the functioning of the locking mechanism 902.

As indicated by arrows 1100, opposing pairs of pantograph arms 112, each pair comprising one arm belonging to the side wall pantograph set 111*a* and one arm belonging to the inside pantograph set 111*b* are drawn toward one another as the barrier 100 is extended.

The locking mechanism 902 is engaged by the servo motor 906 (FIGS. 9, 10) being activated by the supply of power to connector 1001, under control of the programmable logic controller (not shown), as the opposing pairs of pantograph arms 112 are brought into proximity by the extension of the barrier 100 through gravity, causing the latch hook 1012 of one pantograph arm 112 from the lower side wall pantograph set 111*a* (for example, designated 1012*a*) to approach and engage the catch pin 1101 of the complementary pantograph arm 112 from the upper side wall pantograph set 111*a* (designated 1101*b*), while the latch hook 1012*b* of pantograph arm 112 from the upper side wall pantograph set 111*a* approaches and engages the catch pin 1101*a* of pantograph arm 112 of lower sidewall pantograph set 111*a*.

As discussed earlier, when the locking mechanism 902 is engaged or nearly so, the end seal actuator assembly 1020 is actuated by the servo motor 906 to cause the side arms 904 to retract, or incline toward one another, causing the expandable bulb seal 903 to balloon outwards toward the side frame 130. This provides a weather proof seal between the side frame 130 and the pantograph structure 110 while the barrier 100 is fully extended. Microswitch 1031 controls the extent of retraction of the end seal actuator assembly 1020 by controlling the supply of power thereto.

When the barrier 100 is to be retracted, the programmable logic controller (not shown) causes polarity of the power supplied to the connector 1001 to be reversed so that the servo motor 906 causes the latch hook 1012 on each of the complementary pantograph arms 112 in the side wall pantograph set 111*a* to retract from its corresponding catch pin 1101 while at the same time, extending the side arms 904, causing the expandable bulb seal 903 to flatten and retract from the side frame 130 to provide a clearance between it and the side wall pantograph set 111*a*. Microswitch 1032 controls the extent of extension of the end seal actuator assembly 1020 by controlling the supply of power thereto.

Each pantograph arm 112 in the side wall pantograph set 111*a* will have two locking mechanisms 902 mounted thereon, one pointing toward each end thereof. The only difference between the two locking mechanisms 902 is that one (the upper one) will have power supplied thereto along connector 1001 and will supply power to a subsequent (lower) locking mechanism 902 along connector 1002. The lower locking mechanism 902 will have power supplied thereto along connector 1002 and will supply power to a subsequent (lower) locking mechanism 902, namely the upper locking mechanism 902 for the next lower pantograph arm 112 in the side wall pantograph set 111*a* along connector 1001. That is to say, the upper locking mechanisms 902 will have connector 1001 proximate to the end of the pantograph arm 112 and connector 1002 toward the middle thereof, while the lower locking mechanisms 902 will have connector 1002 proximate to the end of the pantograph arm 112 and connector 1001 toward the middle thereof. Alternatively, cable 1003 may extend and interconnect the upper and lower locking mechanisms 902 on a common pantograph arm 112 without resort to connectors 1001 and 1002 toward the middle of the pantograph arm 112.

Figure 12:
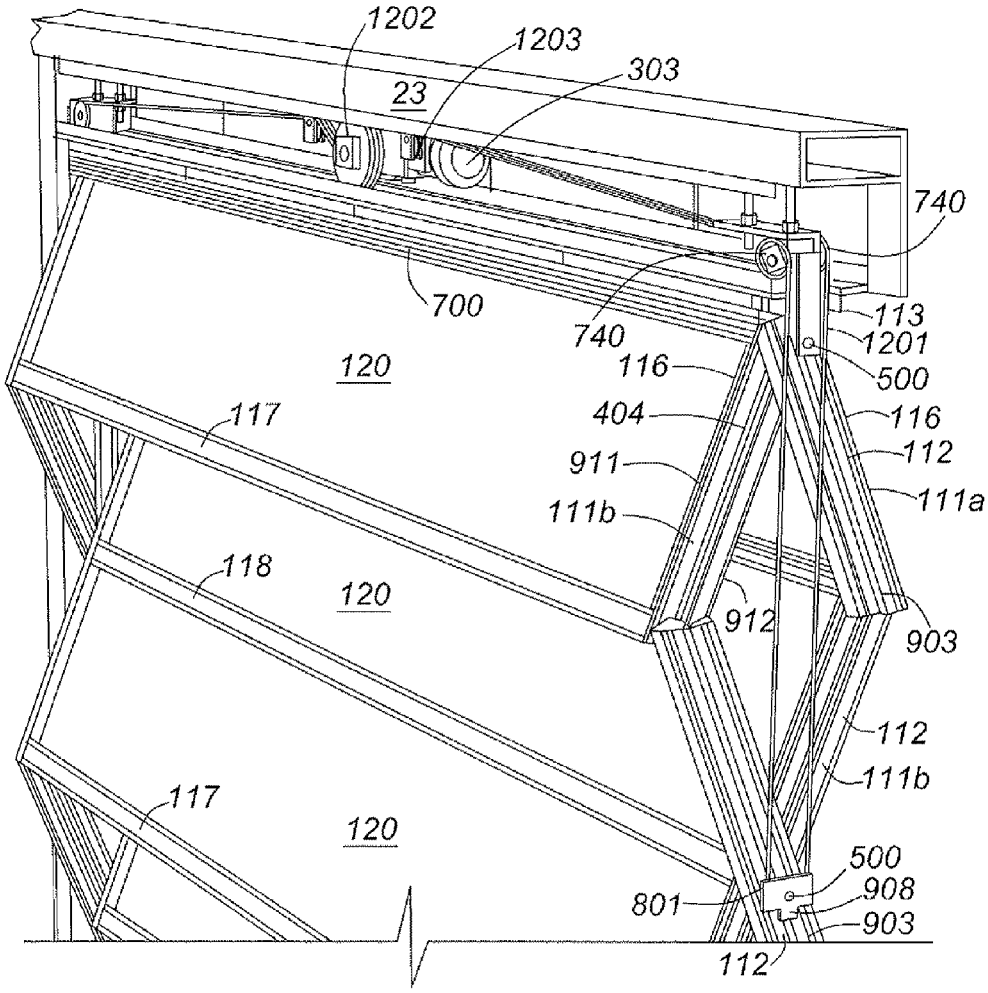
FIG. 12 is a perspective view of the barrier of FIG. 2 viewed from the exterior (wet side) of the enclosure.

Turning now to FIG. 12, there is shown in perspective view from the exterior (wet side) of the enclosure 20, a preferred configuration of the retraction cable 1201 and retraction spool 1202 for controlling the extension and retraction of the barrier 100. Certain covers, valences and the like are removed for purposes of illustration only.

The retraction cable 1201 is affixed at one end to a terminal point 1203, which may be, as shown, a screw bolt attached to a mounting block which in turn is affixed to and beneath or inside the top frame 23.

The retraction cable 1202 is positioned within an exterior circumferential groove about a first sheave 740, runs down through the interior of the side frame 130 (not shown for purposes of illustration) and around the groove in the outer circular surface 802 of one of the sheaves 801 extending at one end of the pivot pin 500, back up through the interior of the side frame 130 and within the exterior circumferential groove about a second sheave 740 and back to the retraction spool 1202.

The sheave 801 is, in the illustrated embodiment, an intermediate one rather than one more lower-positioned. The sheave 801 is covered by cable guide 908, which serves to maintain the retraction cable 1201 within proximity to the groove in the outer circular surface 802 of the sheave 801, especially when there is slack in the retraction cable 1201, such as when the retraction spool 1202 has completed unrolling the retraction cable 1201 and may have slightly over-rotated.

Retraction of the barrier 100 is achieved by rotation of the retraction spool 1202 under control of the lifting motor assembly 303. As the retraction spool 1202 rotates, in the illustrated embodiment in the counter-clockwise direction, retraction cable 1201 is spooled thereon, concomitantly shortening the length of the loop of retraction cable 1201 around the sheave 801 and causing the sheave 801 and the entirety of the barrier 100 to retract. Similarly, extension of the barrier 100 is achieved by rotation of the retraction spool 1202 in the opposite (clockwise in the illustrated embodiment) direction.

A second retraction cable 1201 and retraction spool 1202 will be configured to retract and extend the sheaves 801 on the other side of the barrier 100, although not shown in the Figure. Preferably, the retraction spools 1202 are driven by the same lifting motor assembly 303 to ensure that the barrier 100 remains at all times parallel. Optionally, the barrier 100 may be configured in a manner so as to spool both retraction cables 1201 on a common retraction spool 1202.

Suitable drainage of the enclosure 20 to the outside may be provided in conventional fashion using sills, troughs and weeps in known and well-understood implementations.

In the foregoing description, for purposes of explanation and not limitation, specific details are set forth in order to provide a thorough understanding of the present disclosure. However, it will be apparent to those having ordinary skill in this art that the present disclosure may be practised in other embodiments that depart from these specific details.

In some instances, detailed descriptions of well-known devices, and methods are omitted so as not to obscure the description of the present disclosure with unnecessary detail. All statements herein reciting principles, aspects and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those having ordinary skill in this art that block diagrams reproduced herein can represent conceptual views of illustrative components embodying the principles of the technology.

It will be apparent to those having ordinary skill in this art that various modifications and variations may be made to the embodiments disclosed herein, consistent with the present disclosure, without departing from the spirit and scope of the present disclosure.

While preferred embodiments are disclosed, this is not intended to be limiting. Rather, the general principles set forth herein are considered to be merely illustrative of the scope of the present disclosure and it is to be further understood that numerous changes covering alternatives, modifications and equivalents may be made without straying from the scope of the present disclosure, as defined by the appended claims.

Also, the term "couple" in any form is intended to mean either an direct or indirect connection through other devices and connections.

Moreover, all dimensions described herein are intended solely to be exemplary for purposes of illustrating certain embodiments and are not intended to limit the scope of the invention to any embodiments that may depart from such dimensions as may be specified.

Directional terms such as "upward", "downward", "left" and "right" are used to refer to directions in the drawings to which reference is made unless otherwise stated. Similarly, words such as "inward" and "outward" are used to refer to directions toward and away from, respectively, the geometric centre of a device, area and/or volume and/or designated parts thereof.

References in the singular form include the plural and vice versa, unless otherwise noted.

The terms "including" and "comprising" are used in an open-ended fashion, and thus should be interpreted to mean "including, but not limited to". The terms "example" and "exemplary" are used simply to identify instances for illustrative purposes and should not be interpreted as limiting the scope of the invention to the stated instances. In particular, the term "exemplary" should not be interpreted to denote or confer any laudatory, beneficial or other quality to the expression with which it is used, whether in terms of design, performance or otherwise.

Certain terms are used throughout to refer to particular components. As one skilled in the art will appreciate, manufacturers may refer to a component by different names. It is not intended to distinguish between components that differ in name but not in function.

The purpose of the Abstract is to enable the relevant patent office and/or the public generally, and especially persons having ordinary skill in the art who are not familiar with patent or legal terms or phraseology, to quickly determine from a cursory inspection the nature of the technical disclosure. The Abstract is neither intended to define the invention of this disclosure, which is measured by its claims, nor is it intended to be limiting as to the scope of this disclosure in any way.

Other embodiments consistent with the present disclosure will become apparent from consideration of the specification and the practice of the disclosure disclosed herein.

According to a first broad aspect of an embodiment of the present disclosure there is disclosed a barrier for an opening defined by a top header, a pair of side walls and a bottom threshold, the barrier adapted to be secured to the top header and be upwardly movable into a storage position proximate to the top header thereof and downwardly movable into a closed position to form a wall substantially blocking the opening, the barrier comprising: a plurality of side frames including first and second side frames secured to and extending along the height of each side wall, each side frame having a longitudinal channel therealong facing inward toward the opening; a plurality of wall panels each supported by a rectangular frame comprising a pair of upright panel members, one at each end of the wall panel, each upright panel member having a first end and a second end, and a plurality of horizontal panel members, the plurality of wall panels extending between two adjacent and inward facing side frames; a plurality of upright side wall members at each end of the plurality of wall panels between the upright panel members and the side frames, each upright side wall member having a first end and a second end and being associated with a corresponding upright panel member proximate thereto; the upright side wall members and the corresponding upright panel members proximate to each side frame being configured so that the second end of a first upright side wall member pivotally engages the first end of a second upright panel member, the first end of a second upright side wall member, corresponding to the second upright panel member, pivotally engages the second end of a first upright panel member corresponding to the first upright side wall member, the second end of the second upright side wall member pivotally engages the first end of a third upright panel member and the second end of the second upright panel member engages the first end of a third upright side wall member corresponding to the third upright panel member, so as to form a pantograph structure movable from a collapsed, substantially flat configuration in the storage position to an extended, substantially vertical configuration in the closed position in which the first end of the first upright panel member is substantially adjacent to the second end of the second upright panel member; and a locking mechanism mounted at the first end of the second upright side wall member and adapted to engage a catch pin situated on the second end of the first upright side wall member when the barrier is substantially in the closed position, to pull the wall panels associated with the first and second upright panel members into substantially planar alignment.

According to a second broad aspect of an embodiment of the present disclosure there is disclosed a barrier for an opening defined by a top header, a pair of side walls and a bottom threshold, the barrier adapted to be secured to the top header and be upwardly movable into a storage position proximate to the top header thereof and downwardly movable into a closed position to form a wall substantially blocking the opening, the barrier comprising: a plurality of side frames including first and second side frames secured to and extending along the height of each side wall, having a longitudinal channel therealong facing inward toward the opening; a plurality of wall panels each supported by a rectangular frame comprising a pair of upright panel members, one at each end of the wall panel, each upright panel member having a first end and a second end, and a plurality of horizontal panel members, the plurality of wall panels extending between two adjacent and inward facing side frames; a plurality of upright side wall members at each end of the plurality of wall panels between the upright panel members and the side frames, each upright side wall member having a first end and a second end and being associated with a corresponding upright panel member proximate thereto; the upright side wall members and the corresponding upright panel members proximate to each side frame being configured so that the second end of a first upright side wall member pivotally engages the first end of a second upright panel member, the first end of a second upright side wall member corresponding to the second upright panel member pivotally engages the second end of a first upright panel member corresponding to the first upright side wall member, the second end of the second upright side wall member pivotally engages the first end of a third upright panel member and the second end of the second upright panel member engages the first end of a third upright side wall member corresponding to the third upright panel member, so as to form a pantograph structure movable from a collapsed, substantially flat configuration in the storage position to an extended, substantially vertical configuration in the closed position in which the first end of the first upright panel member is substantially adjacent to the second end of the second upright panel member; an end seal covering the second upright side wall member between its first and second ends and extending between a first and second side arm at opposing sides of the second upright side wall member; and an end seal actuator on the second upright side wall member for selectively retracting the first and second side arms toward one another and causing the end seal to balloon outward to engage and cover the channel in a portion of the side frame proximate to the second upright wall member while the barrier is in the closed position.

Accordingly, the specification and the embodiments disclosed therein are to be considered examples only, with a true scope and spirit of the invention being disclosed by the following claims.

What is claimed is:

1. A barrier for an opening defined by a top header, a pair of side walls and a bottom threshold, the barrier adapted to be secured to the top header and be upwardly movable into a storage position proximate to the top header thereof and downwardly movable into a closed position to form a wall substantially blocking the opening, the barrier comprising:

a plurality of side frames including first and second side frames secured to and extending along the height of each side wall, each side frame having a longitudinal channel therealong facing inward toward the opening;

a plurality of wall panels each supported by a rectangular frame comprising a pair of upright panel members, one at each end of the wall panel, each upright panel member having a first end and a second end, and a plurality of horizontal panel members, the plurality of wall panels extending between two adjacent and inward facing side frames;

a plurality of upright side wall members at each end of the plurality of wall panels between the upright panel members and the side frames, each upright side wall member having a first end and a second end and being associated with a corresponding upright panel member proximate thereto;

the upright side wall members and the corresponding upright panel members proximate to each side frame being configured so that the second end of a first upright side wall member pivotally engages the first end of a second upright panel member, the first end of a second upright side wall member, corresponding to the second upright panel member, pivotally engages the second end of a first upright panel member corresponding to the first upright side wall member, the second end of the second upright side wall member pivotally engages the first end of a third upright panel member and the second end of the second upright panel member engages the first end of a third upright side wall member corresponding to the third upright panel member, so as to form a pantograph structure movable from a collapsed, substantially flat configuration in the storage position to an extended, substantially vertical configuration in the closed position in which the first end of the first upright panel member is substantially adjacent to the second end of the second upright panel member; and a locking mechanism mounted at the first end of the second upright side wall member and adapted to engage a catch pin situated on the second end of the first upright side wall member when the barrier is substantially in the closed position, the locking mechanism on the second upright side wall member including a motor adapted to rotate a latch thereon to engage the catch pin on the first upright side wall member such as to pull the wall panels associated with the first and second upright panel members into substantially planar alignment.

2. A barrier according to claim 1, wherein the motor of the locking mechanism receives power along a first connector on the second upright side wall member when a second connector on the first upright side wall member electrically contacts and mates with the first connector on the first upright side wall member when the barrier is substantially in the closed position.

3. A barrier according to claim 2, wherein the motor is adapted to selectively reverse drive, whereby the latch may be retracted and disengage from the catch pin so as to permit upward movement of the barrier.

4. A barrier according to claim 1, further comprising:

an end seal covering the second upright side wall member between its first and second ends and extending between a first and second side arm at opposing sides of the second upright side wall member; and an end seal actuator coupled to the motor for selectively retracting the first and second side arms toward one another and causing the end seal to balloon outward to engage and cover the channel in a portion of the side frame proximate to the second upright wall member while the barrier is in the closed position and to extend the first and second side arms toward their respective sides when the motor reverses drive, to disengage the end seal from the channel.

5. A barrier according to claim 4, wherein the end seal actuator comprises a first microswitch to stop retraction of the first and second side arms at a first predetermined point, and a second microswitch to stop extension of the first and second side arms at a second predetermined point.

6. A barrier according to claim 1, further comprising:

at least one pivot pin extending laterally outwardly from a corresponding one of the plurality of wall panels through an intersection point between the second upright panel member and the second upright side wall member and into the channel of a corresponding one of the plurality of vertical frames;

a retraction cable extending in a downward loop from the header into the channel of at least one vertical frame and adapted to be lengthened and shortened along at least one end of the retraction cable; and a cylindrical sheave attached to a free end of the pivot pin and situated within the channel of the vertical frame and adapted to engage the loop of the retraction cable thereabout to raise the barrier in response to a shortening of the retraction cable and to lower the barrier in response to a lengthening of the retraction cable.

7. A barrier according to claim 1, further comprising a column extending upwardly from the floor threshold to the top header at an intermediate point in the opening, one of the plurality of side frames secured to and extending along the height of the column on sides lying in a plane defined by the side walls, wherein a plurality of wall panels and upright side wall members extend between each set of adjacent inward facing side frames.

8. A barrier according to claim 1, wherein each frame comprises a pair of horizontal panel extremity members and an horizontal panel intermediate member positioned intermediate therebetween and wherein a first panel is supported between a first horizontal panel extremity member and the horizontal panel intermediate member and a second panel is supported between the second horizontal panel extremity member and the horizontal panel intermediate member.

9. A barrier according to claim 1, wherein the panels are comprised of a rigid material selected from a group consisting of glass, wood, vinyl, sheet metal, plastic and composite material.

10. A barrier according to claim 1, wherein a member selected from a group consisting of an upright panel member, a horizontal panel member and an upright side wall member comprises a plurality of complementary hollow extrusions.

11. A barrier according to claim 10, wherein the complementary hollow extrusions engage and are joined by at least one thermal break strip and a cavity in at least one of the hollow extrusions is filled with an insulating material.

12. A barrier according to claim 1, wherein a length of an upright side wall member is substantially the same as a length of its corresponding upright panel member.

13. A barrier according to claim 1, wherein the first end of the first upright side wall member pivotally engages the first end of the first upright panel member and a length of the first upright side wall member and the first upright panel member is substantially half of a length of the second upright side wall member and the second upright panel member.

14. A barrier according to claim 1, wherein the opening comprises a feature selected from a group consisting of a doorway and a window space.

15. A structure having an opening defined by a top header, a pair of side walls and a bottom threshold into an enclosure, the structure comprising a barrier according to claim 1.

16. A barrier according to claim 1, further comprising an end seal covering the second upright side wall member between its first and second ends and extending between a first and second side arm at opposing sides of the second upright side wall member.

17. A barrier according to claim 16, further comprising an end seal actuator coupled to the motor for selectively retracting the first and second side arms toward one another and causing the end seal to balloon outward to engage and cover the channel in a portion of the side frame proximate to the second upright wall member while the barrier is in the closed position and to extend the first and second side arms toward their respective sides when the motor reverses drive, to disengage the end seal from the channel.

18. A barrier for an opening defined by a top header, a pair of side walls and a bottom threshold, the barrier adapted to be secured to the top header and be upwardly movable into a storage position proximate to the top header thereof and downwardly movable into a closed position to form a wall substantially blocking the opening, the barrier comprising:

a plurality of side frames including first and second side frames secured to and extending along the height of each side wall, having a longitudinal channel therealong facing inward toward the opening;

a plurality of wall panels each supported by a rectangular frame comprising a pair of upright panel members, one at each end of the wall panel, each upright panel member having a first end and a second end, and a plurality of horizontal panel members, the plurality of wall panels extending between two adjacent and inward facing side frames;

a plurality of upright side wall members at each end of the plurality of wall panels between the upright panel members and the side frames, each upright side wall member having a first end and a second end and being associated with a corresponding upright panel member proximate thereto;

the upright side wall members and the corresponding upright panel members proximate to each side frame being configured so that the second end of a first upright side wall member pivotally engages the first end of a second upright panel member, the first end of a second upright side wall member corresponding to the second upright panel member pivotally engages the second end of a first upright panel member corresponding to the first upright side wall member, the second end of the second upright side wall member pivotally engages the first end of a third upright panel member and the second end of the second upright panel member engages the first end of a third upright side wall member corresponding to the third upright panel member, so as to form a pantograph structure movable from a collapsed, substantially flat configuration in the storage position to an extended, substantially vertical configuration in the closed position in which the first end of the first upright panel member is substantially adjacent to the second end of the second upright panel member;

an end seal covering the second upright side wall member between its first and second ends and extending between a first and second side arm at opposing sides of the second upright side wall member; and an end seal actuator on the second upright side wall member for selectively retracting the first and second side arms toward one another and causing the end seal to balloon outward to engage and cover the channel in a portion of the side frame proximate to the second upright wall member while the barrier is in the closed position.

19. A barrier according to claim 18, wherein the end seal actuator on the second upright side wall member comprises a motor adapted to retract the first and second side arms, the motor receiving power along a first connector on the second upright side wall member when a second connector on the first upright side wall member electrically contacts and mates with the first connector on the first upright side wall member when the barrier is substantially in the closed position.

20. A barrier according to claim 19, wherein the motor is adapted to selectively reverse drive, whereby the first and second side arms may be extended toward their respective sides to disengage the end seal from the channel.

21. A barrier according to claim 20, further comprising:

a locking mechanism mounted at the first end of the second upright side wall member and adapted to engage a catch pin situated on the second end of the first upright side wall member when the barrier is substantially in the closed position, to pull the wall panels associated with the first and second upright panel members into substantially planar alignment and to retract and disengage the latch from the catch pin when the motor reverses drive, so as to permit upward movement of the barrier.

22. A barrier for an opening defined by a top header, a pair of side walls and a bottom threshold, the barrier adapted to be secured to the top header and be upwardly movable into a storage position proximate to the top header thereof and downwardly movable into a closed position to form a wall substantially blocking the opening, the barrier comprising:

a plurality of side frames including first and second side frames secured to and extending along the height of each side wall, having a longitudinal channel therealong facing inward toward the opening;

a plurality of wall panels each supported by a rectangular frame comprising a pair of upright panel members, one at each end of the wall panel, each upright panel member having a first end and a second end, and a plurality of horizontal panel members, the plurality of wall panels extending between two adjacent and inward facing side frames;

a plurality of upright side wall members at each end of the plurality of wall panels between the upright panel members and the side frames, each upright side wall member having a first end and a second end and being associated with a corresponding upright panel member proximate thereto;

the upright side wall members and the corresponding upright panel members proximate to each side frame being configured so that the second end of a first upright side wall member pivotally engages the first end of a second upright panel member, the first end of a second upright side wall member corresponding to the second upright panel member pivotally engages the second end of a first upright panel member corresponding to the first upright side wall member, the second end of the second upright side wall member pivotally engages the first end of a third upright panel member and the second end of the second upright panel member engages the first end of a third upright side wall member corresponding to the third upright panel member, so as to form a pantograph structure movable from a collapsed, substantially flat configuration in the storage position to an extended, substantially vertical configuration in the closed position in which the first end of the first upright panel member is substantially adjacent to the second end of the second upright panel member;

an end seal covering the second upright side wall member between its first and second ends and extending between a first and second side arm at opposing sides of the second upright side wall member; and an end seal actuator on the second upright side wall member for selectively retracting the first and second side arms toward one another and causing the end seal to balloon outward to engage and cover the channel in a portion of the side frame proximate to the second upright wall member while the barrier is in the closed position.

23. A barrier according to claim 22, further comprising a locking mechanism mounted at the first end of the second upright side wall member and adapted to engage a catch pin situated on the second end of the first upright side wall member when the barrier is substantially in the closed position, to pull the wall panels associated with the first and second upright panel members into substantially planar alignment and to retract and disengage the latch from the catch pin so as to permit upward movement of the barrier.

* * * * *